US008217591B2

(12) United States Patent
Chobot et al.

(10) Patent No.: US 8,217,591 B2
(45) Date of Patent: Jul. 10, 2012

(54) POWER SOURCE SENSING DIMMING CIRCUITS AND METHODS OF OPERATING SAME

(75) Inventors: Joseph Paul Chobot, Morrisville, NC (US); Michael James Harris, Cary, NC (US); Paul Arthur Beck, Wake Forest, NC (US)

(73) Assignee: Cree, Inc., Durham, NC (US)

( * ) Notice: Subject to any disclaimer, the term of this patent is extended or adjusted under 35 U.S.C. 154(b) by 385 days.

(21) Appl. No.: 12/473,821

(22) Filed: May 28, 2009

(65) Prior Publication Data

US 2010/0301751 A1 Dec. 2, 2010

(51) Int. Cl.
*H05B 37/02* (2006.01)

(52) U.S. Cl. ..... 315/307; 315/86; 315/225; 315/209 R; 315/246; 315/DIG. 4

(58) Field of Classification Search ..... 315/86, 315/209 R, 224, 225, 226, 247, 291, 297, 315/307, 360, DIG. 4
See application file for complete search history.

(56) References Cited

U.S. PATENT DOCUMENTS

| | | | | |
|---|---|---|---|---|
| 3,755,697 | A | | 8/1973 | Miller |
| 3,787,752 | A | | 1/1974 | Delay |
| 4,090,189 | A | | 5/1978 | Fisler |
| 4,717,868 | A | | 1/1988 | Peterson |
| 5,151,679 | A | | 9/1992 | Dimmick |
| 5,175,528 | A | | 12/1992 | Choi et al. |
| 5,345,167 | A | | 9/1994 | Hasegawa et al. |
| 5,661,645 | A | * | 8/1997 | Hochstein ..... 363/89 |
| 5,736,881 | A | | 4/1998 | Ortiz |
| 5,844,377 | A | | 12/1998 | Anderson et al. |
| 5,912,568 | A | | 6/1999 | Kiley |
| 6,150,771 | A | | 11/2000 | Perry |
| 6,161,910 | A | | 12/2000 | Reisenauer et al. |
| 6,222,172 | B1 | | 4/2001 | Fossum et al. |
| 6,285,139 | B1 | | 9/2001 | Ghanem |
| 6,329,760 | B1 | | 12/2001 | Bebenroth |
| 6,340,868 | B1 | | 1/2002 | Lys et al. |
| 6,362,578 | B1 | | 3/2002 | Swanson et al. |
| 6,388,393 | B1 | | 5/2002 | Illingworth |
| 6,400,101 | B1 | | 6/2002 | Biebl et al. |
| 6,528,954 | B1 | | 3/2003 | Lys et al. |

(Continued)

FOREIGN PATENT DOCUMENTS

WO WO 2006/018604 A1 2/2006

OTHER PUBLICATIONS

U.S. Appl. No. 12/328,144, filed Dec. 4, 2008, Chobot.

(Continued)

*Primary Examiner* — Douglas W Owens
*Assistant Examiner* — Thai Pham
(74) *Attorney, Agent, or Firm* — Myers Bigel Sibley & Sajovec, P.A.

(57) ABSTRACT

Lighting is controlled by receiving an input signal, determining whether the input signal is an AC signal or a DC signal and generating a dimming command signal based on the determination of whether the input signal is an AC signal or a DC signal. For example, determining whether the input signal is an AC signal or a DC signal may include generating an average signal indicative of an average duty cycle of the input signal and determining whether the average signal meets a predetermined criterion.

33 Claims, 8 Drawing Sheets

U.S. PATENT DOCUMENTS

| | | | | |
|---|---|---|---|---|
| 6,577,072 | B2 | 6/2003 | Saito et al. | |
| 6,586,890 | B2 | 7/2003 | Min et al. | |
| 6,614,358 | B1 | 9/2003 | Hutchison et al. | |
| 6,636,003 | B2 | 10/2003 | Rahm et al. | |
| 6,724,376 | B2 | 4/2004 | Sakura et al. | |
| 6,747,420 | B2 | 6/2004 | Barth et al. | |
| 6,808,287 | B2 | 10/2004 | Lebens et al. | |
| 6,836,081 | B2 | 12/2004 | Swanson et al. | |
| 6,841,947 | B2 | 1/2005 | Berg-johansen | |
| 6,873,203 | B1 | 3/2005 | Latham, II et al. | |
| 6,900,599 | B2 * | 5/2005 | Ribarich | 315/247 |
| 6,987,787 | B1 | 1/2006 | Mick | |
| 6,995,518 | B2 | 2/2006 | Havlik et al. | |
| 7,038,399 | B2 | 5/2006 | Lys et al. | |
| 7,071,762 | B2 | 7/2006 | Xu et al. | |
| 7,119,498 | B2 | 10/2006 | Baldwin et al. | |
| 7,180,487 | B2 | 2/2007 | Kamikawa et al. | |
| 7,202,608 | B2 | 4/2007 | Robinson et al. | |
| 7,218,056 | B1 | 5/2007 | Harwood | |
| 2001/0024112 | A1 * | 9/2001 | Jacobs et al. | 323/282 |
| 2002/0027453 | A1 * | 3/2002 | Kulhalli et al. | 327/96 |
| 2002/0063534 | A1 * | 5/2002 | Min | 315/169.3 |
| 2006/0175983 | A1 * | 8/2006 | Crouse et al. | 315/291 |
| 2007/0257999 | A1 * | 11/2007 | Chou | 348/300 |
| 2008/0258628 | A1 | 10/2008 | Higley et al. | |
| 2009/0184662 | A1 * | 7/2009 | Given et al. | 315/294 |
| 2010/0066266 | A1 * | 3/2010 | Huang et al. | 315/291 |
| 2010/0308738 | A1 | 12/2010 | Shteynberg et al. | |
| 2010/0308749 | A1 * | 12/2010 | Liu | 315/307 |

OTHER PUBLICATIONS

U.S. Appl. No. 12/328,115, filed Dec. 4, 2008, Chobot.

U.S. Appl. No. 11/854,744, filed Sep. 13, 2007, Myers.

U.S. Appl. No. 60/844,325, filed Sep. 13, 2006, Myers.

International Preliminary Report on Patentability corresponding to International Application No. PCT/US2010/029897; Date of Mailing: Apr. 27, 2011; 14 pages.

Notification of transmittal of the international search report and the written opinion of the international searching authority, or declaration, PCT/US2010/029897, Jun. 23, 2010.

* cited by examiner

POWER SOURCE SENSING DIMMING CIRCUITS AND METHODS OF OPERATING SAME

FIELD OF THE INVENTION

The present inventive subject matter relates to lighting devices and more particularly to dimming control for light emitting devices.

BACKGROUND OF THE INVENTION

Many control circuits for lighting use phase cut dimming. In phase cut dimming, a portion of the AC waveform, for example, the leading or trailing edge, is blanked ("cut") to reduce the RMS voltage provided to a lighting device. When used with incandescent lamps, this reduction in RMS voltage results in a corresponding reduction in current and, therefore, a reduction in power consumption and light output. As the RMS voltage decreases, the light output from the incandescent lamp decreases.

Recently, solid state lighting systems have been developed that provide light for general illumination. These solid state lighting systems utilize light emitting diodes or other solid state light sources that are coupled to a power supply that receives the AC line voltage and converts that voltage to a voltage and/or current suitable for driving the solid state light emitters. Typical power supplies for light emitting diode light sources include linear current regulated supplies and/or pulse width modulated current and/or voltage regulated supplies.

Many different techniques have been described for driving solid state light sources in many different applications, including, for example, those described in U.S. Pat. No. 3,755,697 to Miller, U.S. Pat. No. 5,345,167 to Hasegawa et al, U.S. Pat. No. 5,736,881 to Ortiz, U.S. Pat. No. 6,150,771 to Perry, U.S. Pat. No. 6,329,760 to Bebenroth, U.S. Pat. No. 6,873,203 to Latham, II et al, U.S. Pat. No. 5,151,679 to Dimmick, U.S. Pat. No. 4,717,868 to Peterson, U.S. Pat. No. 5,175,528 to Choi et al, U.S. Pat. No. 3,787,752 to Delay, U.S. Pat. No. 5,844,377 to Anderson et al, U.S. Pat. No. 6,285,139 to Ghanem, U.S. Pat. No. 6,161,910 to Reisenauer et al, U.S. Pat. No. 4,090,189 to Fisler, U.S. Pat. No. 6,636,003 to Rahm et al, U.S. Pat. No. 7,071,762 to Xu et al, U.S. Pat. No. 6,400,101 to Biebl et al, U.S. Pat. No. 6,586,890 to Min et al, U.S. Pat. No. 6,222,172 to Fossum et al, U.S. Pat. No. 5,912,568 to Kiley, U.S. Pat. No. 6,836,081 to Swanson et al, U.S. Pat. No. 6,987,787 to Mick, U.S. Pat. No. 7,119,498 to Baldwin et al, U.S. Pat. No. 6,747,420 to Barth et al, U.S. Pat. No. 6,808,287 to Lebens et al, U.S. Pat. No. 6,841,947 to Bergjohansen, U.S. Pat. No. 7,202,608 to Robinson et al, U.S. Pat. No. 6,995,518, U.S. Pat. No. 6,724,376, U.S. Pat. No. 7,180,487 to Kamikawa et al, U.S. Pat. No. 6,614,358 to Hutchison et al, U.S. Pat. No. 6,362,578 to Swanson et al, U.S. Pat. No. 5,661,645 to Hochstein, U.S. Pat. No. 6,528,954 to Lys et al, U.S. Pat. No. 6,340,868 to Lys et al, U.S. Pat. No. 7,038,399 to Lys et al, U.S. Pat. No. 6,577,072 to Saito et al, and U.S. Pat. No. 6,388,393 to Illingworth.

In many installations, emergency lighting that normally runs from a primary AC source (e.g., AC line voltage) is backed up by an auxiliary high-voltage DC source, for example, a battery. When AC power is lost in a building or branch circuit, the DC voltage is supplied over the same busses that are used to supply the normal AC power. Generally, it is desirable to reduce illumination levels produced by emergency lighting to near minimum levels to reduce power consumption and extend battery life while still meeting safety requirements.

SUMMARY OF THE INVENTION

In some embodiments of the present invention subject matter, a lighting control circuit includes a dimming command signal generation circuit configured to receive an input signal and to responsively generate a dimming command signal to apply a dimming that varies over a range between a minimum dimming and a maximum dimming responsive to variation of a dimming control signal when the input signal is an AC signal and to apply a fixed dimming greater than the minimum dimming when the input signal is a DC signal. For example, in some embodiments, the dimming command signal generation circuit may include an dimming control signal generation circuit configured to generate a average signal indicative of an average duty cycle of the input signal and a variable gain circuit configured to apply a first gain to the dimming control signal to generate the dimming command signal when the average signal meets a predetermined criterion and to apply a second gain to the dimming control signal to generate the dimming command signal when the average signal fails to meet the predetermined criterion. The dimming control signal may include or be derived from the average signal, a PWM binary dimmer signal or an analog dimmer signal.

In further embodiments, the dimming control signal generation circuit includes a conversion circuit configured to generate a pulse-width-modulated (PWM) binary signal having a duty cycle corresponding to the duty cycle of the input signal and an averaging circuit configured to generate an average signal having a level representative of an average of the PWM binary signal. The variable gain circuit may include a selective scaling circuit configured to compare the average signal to a reference signal and to scale the dimming control signal responsive to the comparison. The variable gain circuit may further include a PWM circuit configured to generate the dimming command signal as a PWM dimming command signal from the scaled dimming control signal. The PWM circuit may be configured to compare the scaled dimming control signal to a periodic reference signal to generate the PWM dimming command signal. The lighting control circuit may further include a periodic reference signal generator configured to generate the periodic reference signal. The lighting control circuit may further include a light-emitting diode (LED) drive circuit configured to drive an LED responsive to the dimming command signal.

Further embodiments of the present inventive subject matter provide a lighting control circuit including a sense signal input, a dimming control signal generation circuit configured to generate a dimming control signal and a variable gain circuit configured to apply a first gain to the dimming control signal responsive to a first state of a signal at the sense signal input to generate a dimming command signal and to apply a second gain to the dimming control signal responsive to a second state of the signal at the sense signal input to generate the dimming command signal.

The dimming control signal generation circuit may be configured to generate the dimming control signal responsive to the signal at the sense signal input. For example, the dimming control signal generation circuit may be configured to generate the dimming control signal responsive to an AC phase-cut dimmer signal and the variable gain circuit may be configured to selectively apply the first and second gains responsive to the AC phase-cut dimmer signal. In other embodiments, the dimming control signal generation circuit may be configured to generate the dimming control signal responsive to a PWM binary dimmer signal or to an analog dimmer signal.

In some embodiments, the dimming control signal generation circuit is configured to determine an average duty cycle of the signal at the sense signal input and the variable gain circuit is configured to selectively apply the first and second gains responsive to the determined duty cycle. The dimming control signal generation circuit may include a conversion circuit configured to generate a pulse-width-modulated (PWM) binary signal having a duty cycle corresponding to the duty cycle of the input signal and an averaging circuit configured to generate an average signal having a level representative of an average of the PWM binary signal. The variable gain circuit may include a selective scaling circuit configured to compare the average signal to a reference signal and to scale the dimming control signal responsive to the comparison and a PWM circuit configured to generate the dimming command signal as a PWM dimming command signal from the scaled dimming control signal. The PWM circuit may be configured to compare the scaled dimming control signal to a periodic reference signal to generate the PWM dimming command signal, and the lighting control circuit may further include a periodic reference signal generator circuit configured to generate the periodic reference signal. The lighting control circuit may also include a light-emitting diode (LED) drive circuit configured to drive an LED responsive to the dimming command signal.

According to some method embodiments of the present inventive subject matter, a dimming command signal is generated responsive to an input signal to apply a dimming that varies over a range between a minimum dimming and a maximum dimming responsive to a dimming control signal when the input signal is an AC signal and to apply a fixed dimming greater than the minimum dimming when the input signal is a DC signal. The methods may include generating an average signal indicative of an average duty cycle of the input signal, applying a first gain the dimming control signal when the average signal meets a predetermined criterion to generate the dimming command signal and applying a second gain to the dimming control signal when the average signal fails to meet the predetermined criterion to generate the dimming command signal. The dimming control signal may include or be derived from the input signal (e.g., AC phase-cut dimmer signal), a PWM binary dimmer signal or an analog dimmer signal.

Further embodiments of the present invention provide lighting control circuits including a dimming command signal generation circuit configured to receive an input signal, to determine whether the input signal is an AC signal or a DC signal, and to responsively generate a dimming command signal based on the determination of whether the input signal is an AC signal or a DC signal. The dimming command signal generation circuit may include a dimming control signal generation circuit configured to generate an average signal indicative of an average duty cycle of the input signal and a variable gain circuit configured to apply a first gain to a dimming control signal to generate the dimming command signal when the average signal meets a predetermined criterion and to apply a second gain to the dimming control signal to generate the dimming command signal when the average signal fails to meet the predetermined criterion.

In additional method embodiments, lighting is controlled by receiving an input signal, determining whether the input signal is an AC signal or a DC signal and generating a dimming command signal based on the determination of whether the input signal is an AC signal or a DC signal. For example, determining whether the input signal is an AC signal or a DC signal may include generating an average signal indicative of an average duty cycle of the input signal and determining whether the average signal meets a predetermined criterion. Generating a dimming command signal based on the determination of whether the input signal is an AC signal or a DC signal may include applying a first gain to a dimming control signal to generate the dimming command signal when the average signal meets the predetermined criterion and applying a second gain to the dimming control signal to generate the dimming command signal when the average signal fails to meet the predetermined criterion.

DETAILED DESCRIPTION

Figure 1:
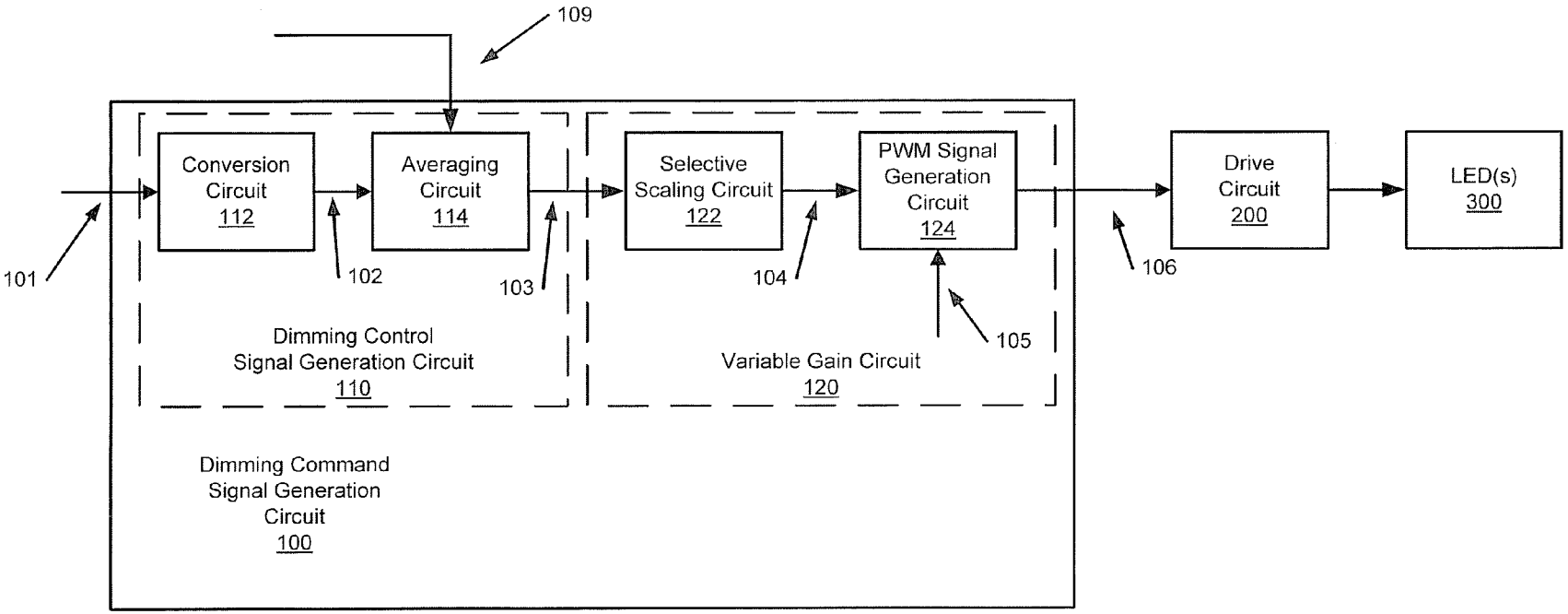
FIG. 1 is a schematic diagram illustrating a light-emitting diode (LED) lighting system according to some embodiments of the present inventive subject matter.

The present inventive subject matter is described more fully hereinafter with reference to the accompanying drawings, in which embodiments of the present inventive subject matter are shown. The present inventive subject matter may, however, be embodied in many different forms and should not be construed as limited to the embodiments set forth herein. Rather, these embodiments are provided so that this disclosure will be thorough and complete, and will fully convey the scope of the present inventive subject matter to those skilled in the art. In the drawings, features may be exaggerated for clarity.

It will be understood that when an element is referred to as being "connected to" or "coupled to" another element (and variants thereof), it can be directly connected or coupled to the other element or intervening elements may be present. In contrast, when an element is referred to as being "directly connected to" or "directly coupled to" another element, there are no intervening elements present. Like reference numerals refer to like elements throughout. As used herein, the term "and/or" includes any and all combinations of one or more of the associated listed items and may be abbreviated as "/".

It will be understood that, although the terms "first", "second", "third", etc. may be used herein to describe various elements and/or components, these elements and/or components are not limited by these terms. These terms are only used to distinguish one element or component from another element or component. Thus, a first element or component discussed below could be termed a second element or component without departing from the teachings of the present inventive subject matter.

The terminology used herein is for the purpose of describing particular embodiments only and is not intended to be limiting of the present inventive subject matter. As used herein, the singular forms "a," "an" and "the" are intended to include the plural forms as well, unless the context clearly indicates otherwise. It will be further understood that the terms "comprising", "including", "having" and variants thereof, when used in this specification, specify the presence of stated features, steps, operations, elements, and/or components, but do not preclude the presence or addition of one or more other features, steps, operations, elements, components, and/or groups thereof. In contrast, the term "consisting of" when used in this specification, specifies the stated features, steps, operations, elements, and/or components, and precludes additional features, steps, operations, elements and/or components.

Unless otherwise defined, all terms (including technical and scientific terms) used herein have the same meaning as commonly understood by one of ordinary skill in the art to which the present inventive subject matter belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Various aspects of the present inventive subject matter include various combinations of electronic circuits including components such as resistors, capacitors, diodes, transistors, etc. It will be appreciated that, in general, the circuits described herein (and/or any portions of such circuits) can be provided in the form of (1) one or more discrete components, (2) one or more integrated circuits, or (3) combinations of one or more discrete components and one or more integrated circuits.

U.S. patent application Ser. No. 12/328,144, entitled "Frequency Converted Dimming Signal Generation" and U.S. patent application Ser. No. 12/328,115, entitled "Dimming Signal Generation and Methods of Generating Dimming Signals," both filed Dec. 4, 2008, assigned to the assignee of the present application and incorporated by reference herein in their entireties as if physically present, describe various techniques for dimming light emitting devices using dimmers that are compatible with traditional incandescent and fluorescent lighting control circuitry, including AC phase cut dimmers, level control signal dimmers and pulse width modulation (PWM) dimmers. Some embodiments of the present inventive subject matter arise from an inventive realization that, in applications of such circuits in which backup power capacity may be limited, it may be advantageous to dim lighting devices to a predetermined level in response to detecting the presence of backup power in order to conserve power. In some embodiments, a dimming command signal (e.g., a signal to be applied to a driver for a lighting device, such as one or more LED's) is generated based on a determination of whether an input signal (e.g., an AC phase cut dimmer signal or an AC power supply signal) is in an AC or DC state. In further embodiments, a dimming command signal generation circuit may be configured to generate a dimming command signal to apply a dimming that varies over a range between a minimum dimming and a maximum dimming proportional to a duty cycle of an input signal from a device such as an AC phase cut dimmer when the input signal is an AC signal and to apply a fixed dimming greater than the minimum dimming when the input signal is a DC signal. The dimming applied when the input signal is a DC signal may be, for example, a dimming that reduces or minimizes power consumption by providing an illumination that is less than that that afforded when minimum dimming is applied under conditions in which the input signal is an AC signal. The dimming command signal may be applied, for example, to a drive circuit that drives a lighting device, such as an LED lighting device.

FIG. 1 illustrates a lighting system 10 according to some embodiments of the present inventive subject matter. As illustrated, the lighting system 10 includes a drive circuit 200 and a lighting device, here illustrated as one or more LEDs 300. The drive circuit 200 drives the LED(s) 300 responsive to a dimming command signal 106 generated by a dimming command signal generation circuit 100. The dimming command signal generation circuit 100 receives an input signal 101. In some embodiments, the input signal 101 may be, for example, a signal received from a conventional phase-cut dimmer circuit (or a derivative thereof), which under normal conditions is an AC signal subject to phase cutting and which under emergency conditions is a DC signal generated from a backup DC power source. In some embodiments, the dimming command signal generation circuit 100 may generate the dimming command signal 106 from the input signal 101 by selectively applying different gains to the input signal 101 depending on a state (e.g., AC or DC) of the input signal. In other embodiments, the input signal 101 may be an AC power supply signal (e.g., a scaled version of the AC power supply voltage), and may be used to selectively apply different gains to a dimmer control signal 109 (e.g., a signal generated from a PWM binary dimmer signal or an analog dimmer signal) and the input signal 101 based on the state of the input signal 101.

In some embodiments of the present inventive subject matter, the dimming command signal 106 is a pulse-width modulated (PWM) binary signal having a significantly higher frequency than the input signal 106 and a duty cycle that depends on the duty cycle of the input signal 101. The duty cycle of the dimming command signal 106 may be substantially the same as the duty cycle of the input signal 101 or it may differ according to a predefined relationship. For example, the duty cycle of the dimming command signal 106 may have a linear or non-linear relationship to the duty cycle of the input signal 101. The duty cycle of the dimming command signal 106 generally may not track the duty cycle of the input signal 101 on a cycle by cycle basis. Such a relationship may be beneficial, for example, if substantial variations may occur in the duty cycle of the input signal 101, as may occur, for example, in the output of a conventional AC phase cut dimmer even without changing the setting of the dimmer. Therefore, the dimming command signal 101 may, in some embodiments, have a duty cycle that is related to a smoothed or average duty cycle of the input signal 101. This smoothing or averaging may reduce the likelihood that unintended variations in the duty cycle of the input signal 101 will result in undesirable changes in intensity of the light output by the lighting system 10 while still allowing for changes in the dimming level.

In some embodiments illustrated in FIG. 1, the dimming command signal generation circuit 100 includes a dimming control signal generation circuit 110 and a variable gain circuit 120. In some embodiments, the dimming control signal generation circuit 110 generates an average signal 103 representative of an average duty cycle of the input signal 101. The variable gain circuit 120 selectively applies first and second gains to the average signal 103 based on the average signal (e.g., based on a voltage level thereof) to generate the dimming command signal 106.

As further illustrated, the dimming control signal generation circuit 110 may include a conversion circuit 112 which, responsive to the input signal 101, produces a PWM binary signal 102 having a duty cycle that depends on the duty cycle of the input signal 101. The PWM binary signal 102 is provided to an averaging circuit 114 that generates the average signal 103, such that average signal 103 represents an average value of the PWM binary signal 102. There may any of a number of different relationships between the duty cycle of the PWM binary signal 102 and the duty cycle of the input signal 101. In some embodiments, the PWM binary signal 102 is a fixed amplitude waveform with a duty cycle corresponding to (i.e., based on, but not necessarily the same as) the duty cycle of the waveform of the input signal 101. For example, in various embodiments of the invention, the duty cycled of the PWM binary signal 102 may be directly related to or inversely related to the duty cycle of the input signal 101. The expression "related to" encompasses relationships wherein the duty cycle of the PWM binary signal 102 is linearly proportional or inversely proportional to the duty cycle of the input signal 101 or relationships wherein there is a non-linear relationship.

As further illustrated, the variable gain circuit 120 includes a selective scaling circuit 122 that receives the average signal 103 and responsively generates a scaled signal 104 that is applied to a PWM signal generation circuit 124. The PWM signal generation circuit 124 compares the scaled signal 104 to a waveform reference signal 105 to generate the dimming command signal 106 as a PWM binary signal. The scaled signal 104 is selectively scaled based on the level of the average signal 103. For example, in some embodiments, the scaled signal 104 is selectively scaled based on comparison of the average signal 103 to a reference signal having a level that is indicative of a transition of the input signal 101 from an AC signal to a DC signal, as might occur when a backup DC power supply is active.

The waveform reference signal 105 may be, for example, a triangle, sawtooth or other periodic waveform. In some embodiments, the frequency of the waveform reference signal 105 may be greater than 200 Hz, and in particular embodiments, the frequency may be about 300 Hz (or higher). The waveform of the waveform reference signal 105 may be selected to provide the desired relationship between the dimming information contained in the input signal 101 (duty cycle) and the duty cycle of the dimming command signal 106. The waveform reference signal 105 and the scaled signal 104 are compared by the PWM signal generation circuit 124, which generates a waveform having the frequency of the waveform reference signal 105 and a duty cycle that depends on the scaled signal 104.

Still referring to FIG. 1, the drive circuit 200 may include any of a number of different types of drive circuits capable of responding to a pulse width modulated input that reflects the level of dimming of the LED(s) 300. The particular configuration of the drive circuit 200 may depend on the application of the lighting system 10. For example, the drive circuit 200 may be a boost or buck power supply or a constant current or constant voltage pulse width modulated power supply, for example, along the lines of drive circuits described in U.S. Pat. No. 7,071,762. In other embodiments, the drive circuit 200 may be a drive circuit using linear regulation, such as described in U.S. Pat. No. 7,038,399 and in U.S. Patent Application No. 60/844,325, filed on Sep. 13, 2006, entitled "BOOST/FLYBACK POWER SUPPLY TOPOLOGY WITH LOW SIDE MOSFET CURRENT CONTROL", and U.S. patent application Ser. No. 11/854,744, filed Sep. 13, 2007 entitled "Circuitry for Supplying Electrical Power to Loads."

Figure 2:
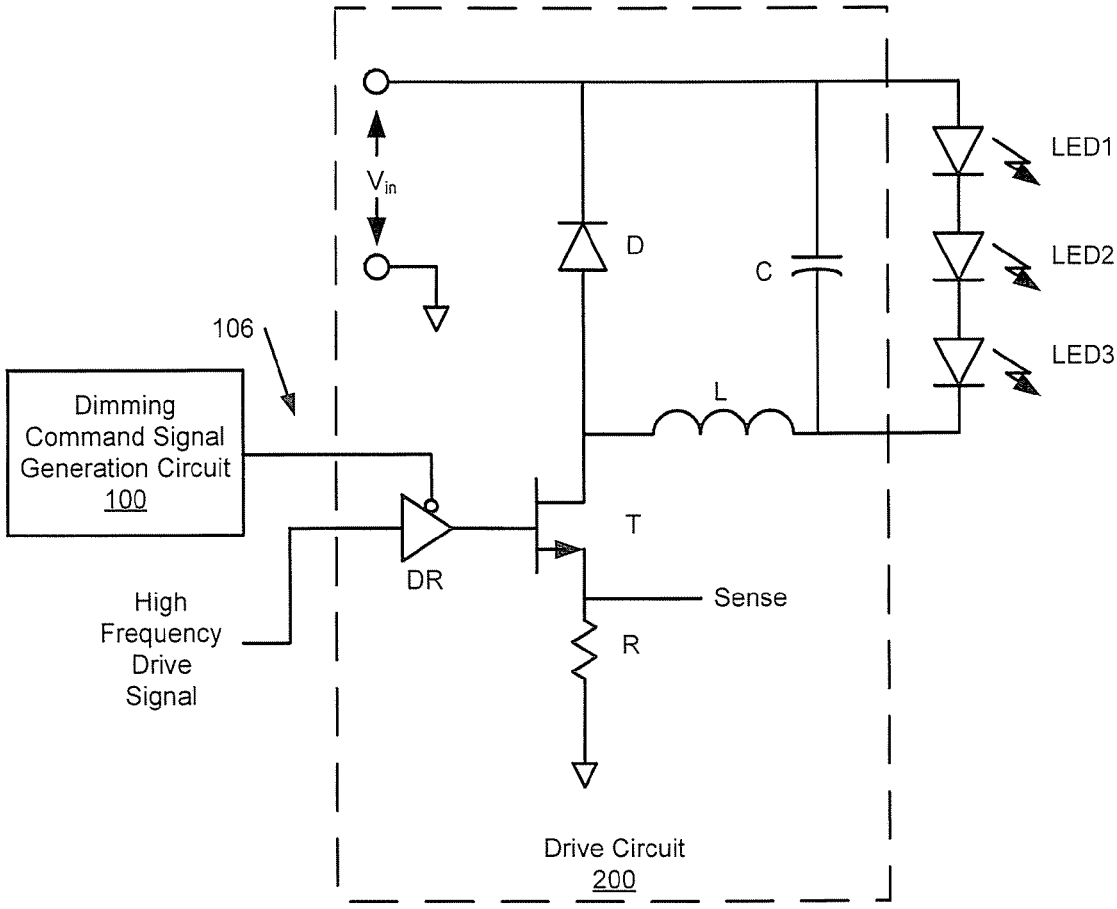
FIG. 2 is a schematic diagram illustrating an implementation of an LED drive circuit for the circuit of FIG. 1 according to some embodiments of the present inventive subject matter.

FIG. 2 illustrates an implementation of a drive circuit 200 according to some embodiments of the present inventive subject matter. The drive circuit 200 drives a string of LEDs LED1, LED2, LED3 with an input voltage $V_{in}$ that is modulated by a high frequency drive signal applied to a driver DR that drives the gate of a transistor T. A diode D, capacitor C and inductor L provide current smoothing between cycles of the high frequency drive signal. A resistor R provides a current sense that can be fed back to a driver controller that varies the duty cycle of the high frequency drive signal to provide a constant current to the LEDs LED1, LED2, LED3. The driver DR is enabled by the dimming command signal output by the dimming command signal generation circuit 100. Because the transistor T is controlled by the dimming command signal generation circuit 100, it may be necessary to disable or otherwise control or compensate for the current sense feedback to the controller when the transistor T is off.

Figure 3:
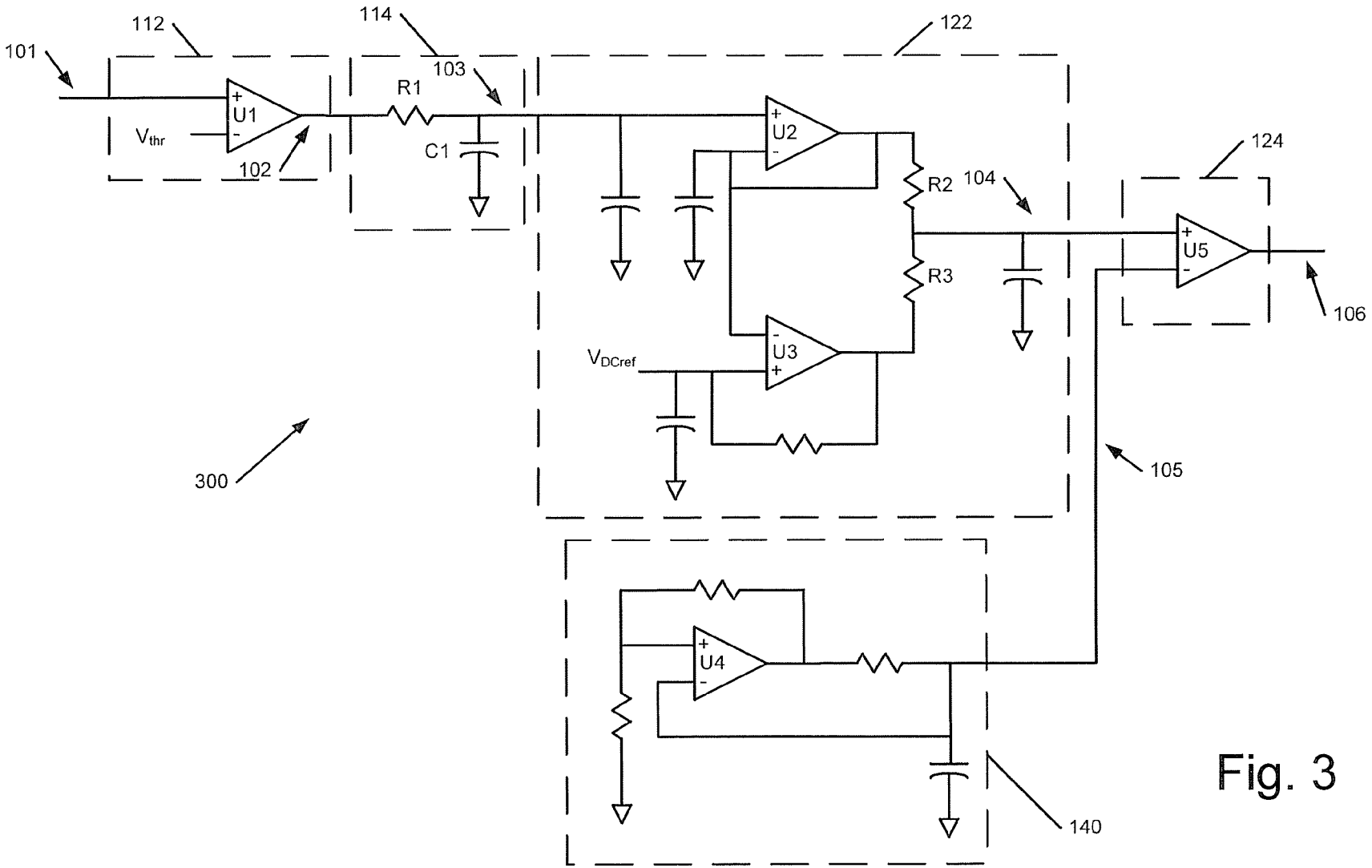
FIGS. 3 and 4 are schematic diagrams illustrating implementations of dimming control for the system of FIG. 1 according to some embodiments of the present inventive subject matter.

FIG. 3 illustrates a dimming command signal generation circuit 300 according to further embodiments of the present inventive subject matter. The dimming command signal generation circuit 300 includes a conversion circuit 112, an averaging circuit 114, a selective scaling circuit 122 and a PWM signal generation circuit 124 having functions along the lines discussed above with reference to FIG. 1, along with a waveform reference signal generation circuit 140 that generates a waveform reference signal 105. An input signal 101, for example, a voltage derived from the output of a phase-cut dimmer by scaling to an appropriate voltage level using, for example, a resistor divider network, is applied to a first input of a comparator U1 of the conversion circuit 112. The comparator U1 compares the input signal 101 to a voltage reference $V_{thr}$ applied to a second input of the comparator U1. When the input signal 101 exceeds the voltage reference $V_{thr}$, the output of the comparator U1 is driven "high." When the reverse is true, the output of the comparator U1 is driven "low." In embodiments where the duty cycle of the output of the duty cycle detection circuit is inversely related to the duty cycle of the input voltage, the comparator U1 may be reversed, such that the input signal is supplied to the negative input of the comparator U1 and the voltage reference is supplied to the positive input of the comparator U1.

The PWM binary signal 102 produced by the conversion circuit 112 is filtered by the averaging circuit 114 to generate an average signal 103 representative of an average value of the PWM binary signal 102. The averaging circuit 114 is illustrated as a low-pass filter that includes a resistor R1 and a capacitor C1, but it will be appreciated that other types of filter circuits may be used for the averaging circuit 114.

The average signal 103 is provided to an amplifier U2 in the selective scaling circuit 122. The amplifier U2, which is configured as a voltage follower, produces an output signal that is applied to the input of a comparator U3 and to a voltage divider including resistors R2, R3. The voltage divider produces a selectively scaled signal 104 that is applied to a first input of a comparator U5 of the PWM signal generation circuit 124. The comparator U5 compares the selectively scaled signal 104 to a waveform reference signal 105 produced by the waveform reference signal generation circuit 140 to generate a dimming command signal 106 as a PWM binary signal. As shown, the reference waveform signal generation circuit includes an amplifier U4 configured as a triangle wave generator, but it will be appreciated that circuits that generate other types of periodic waveforms, such as sawtooth or sine wave generators, may be used in various embodiments of the present inventive subject matter.

The comparator U3 of the selective scaling circuit 122 compares the output of the amplifier U2 to a reference signal $V_{DCref}$, which has a voltage representative of a level of the average signal 103 that corresponds to the input signal 101 being a DC voltage. If the output of the amplifier U2 is less than the reference signal $V_{DCref}$, the output of the comparator U3 presents a high impedance and no voltage division (i.e., reduced scaling or gain) is applied to the output of the amplifier U2 to produce the selectively scaled signal 104. However, if the output of the amplifier U2 is greater than the reference signal $V_{DCref}$, the output of the comparator U3 is pulled down, causing division of the output of the amplifier U2 by the resistors R2, R3. As a result, the scaling (gain) applied by the selectively scaling circuit 122 is reduced and the duty cycle of the dimming command signal 106 is correspondingly altered to provide a fixed dimming greater than a minimum dimming under AC conditions of the input signal 101 responsive to the input signal 101 becoming a DC signal due to replacement of an AC source with a backup DC source. The value of the ratio of the resistors R2, R3 may be chosen such that the illumination provided under DC power meets requirements for emergency lighting.

Figure 4:
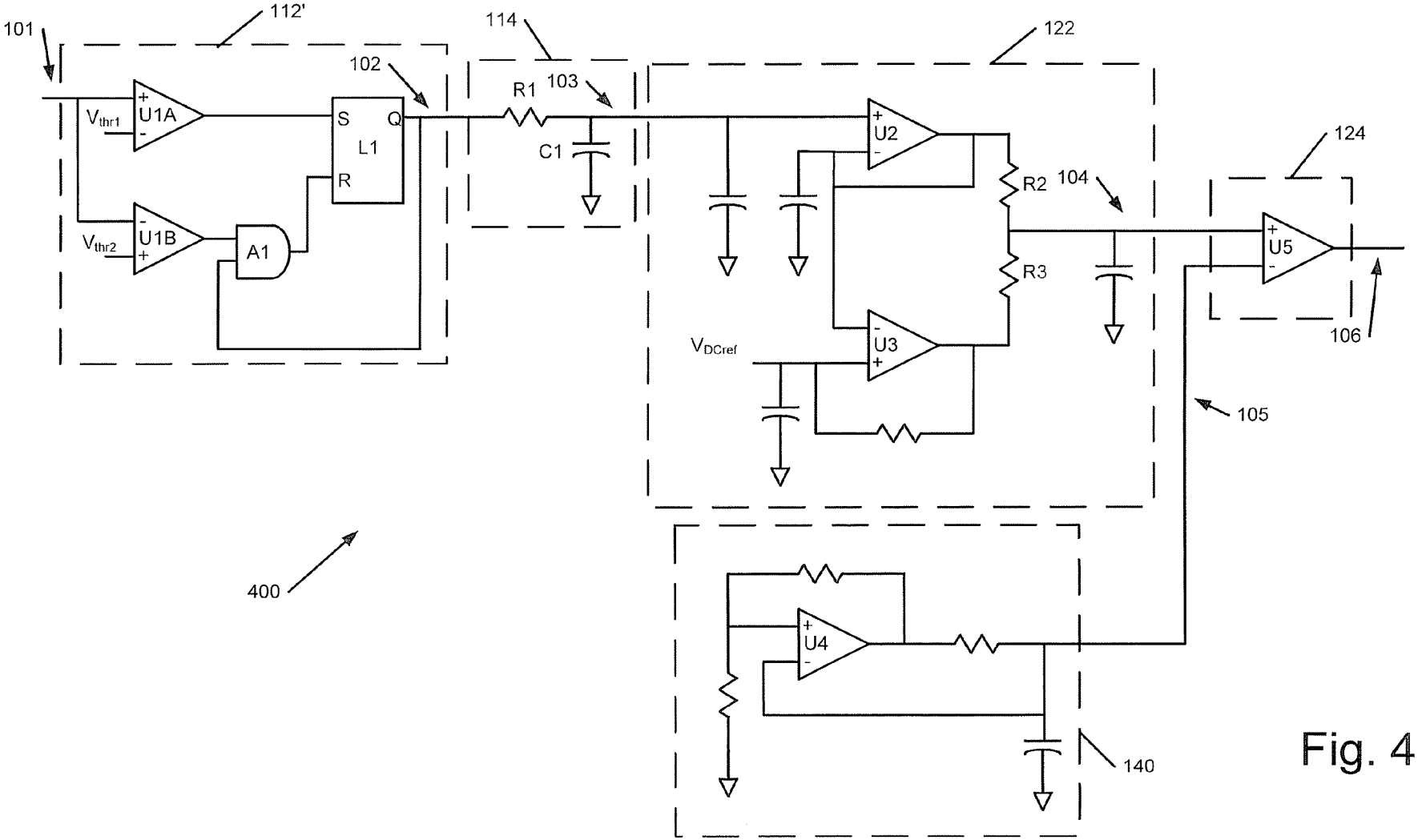

FIG. 4 illustrates a dimming command signal generation circuit 400 that represents a modification of the circuit of FIG. 3, in which the symmetric conversion circuit 112 is replaced by an asymmetric conversion circuit 112'. Like items of FIGS. 3 and 4 are indicated by like reference designators, and repeated discussion of these like items is omitted in light of the foregoing description of FIG. 3. The asymmetric conversion circuit 112' includes first and second comparators U1A, U1B, a logic AND gate A1 and a Set/Reset latch L1 that provide independently settable on and off thresholds $V_{thr1}$, $V_{thr2}$. In some applications, an AC waveform from a triac-based phase cut dimmer may exhibit imbalances between positive and negative cycles of the AC waveform. The different thresholds afforded by the asymmetric conversion circuit 112' can allow different thresholds to be defined for the positive and negative half cycles to provide a more stable PWM binary signal 102.

Figure 5:
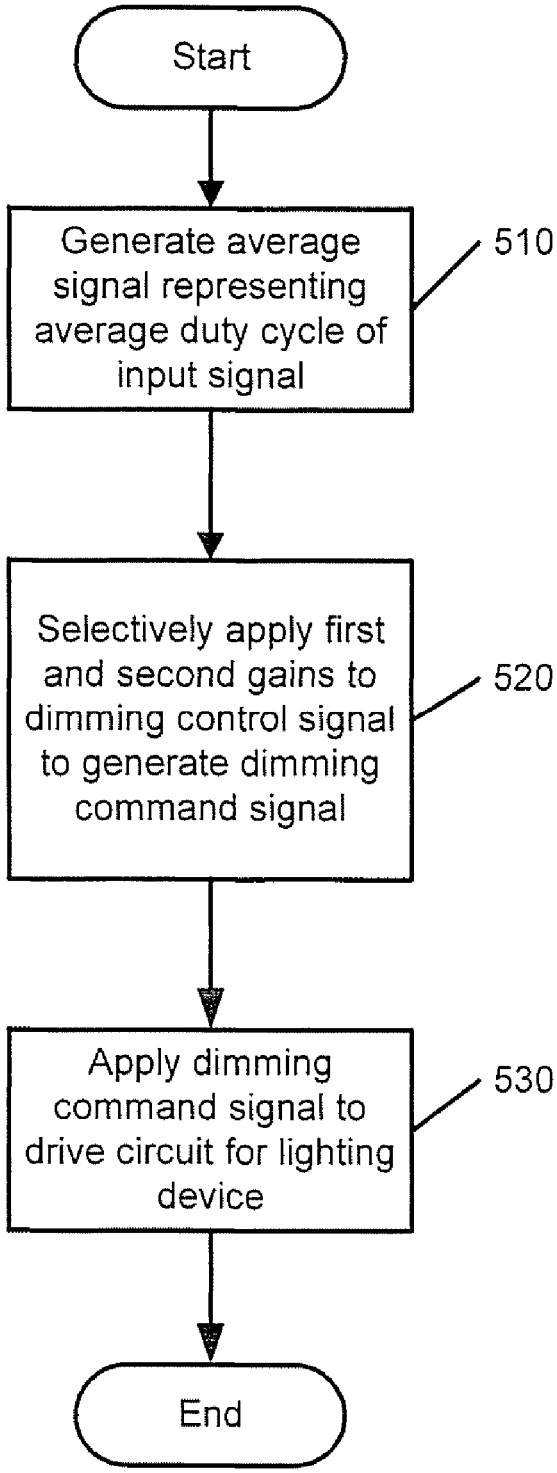
FIGS. 5 and 6 are flowcharts illustrating power-sensing dimming control operations according to some embodiments of the present inventive subject matter.
Figure 6:
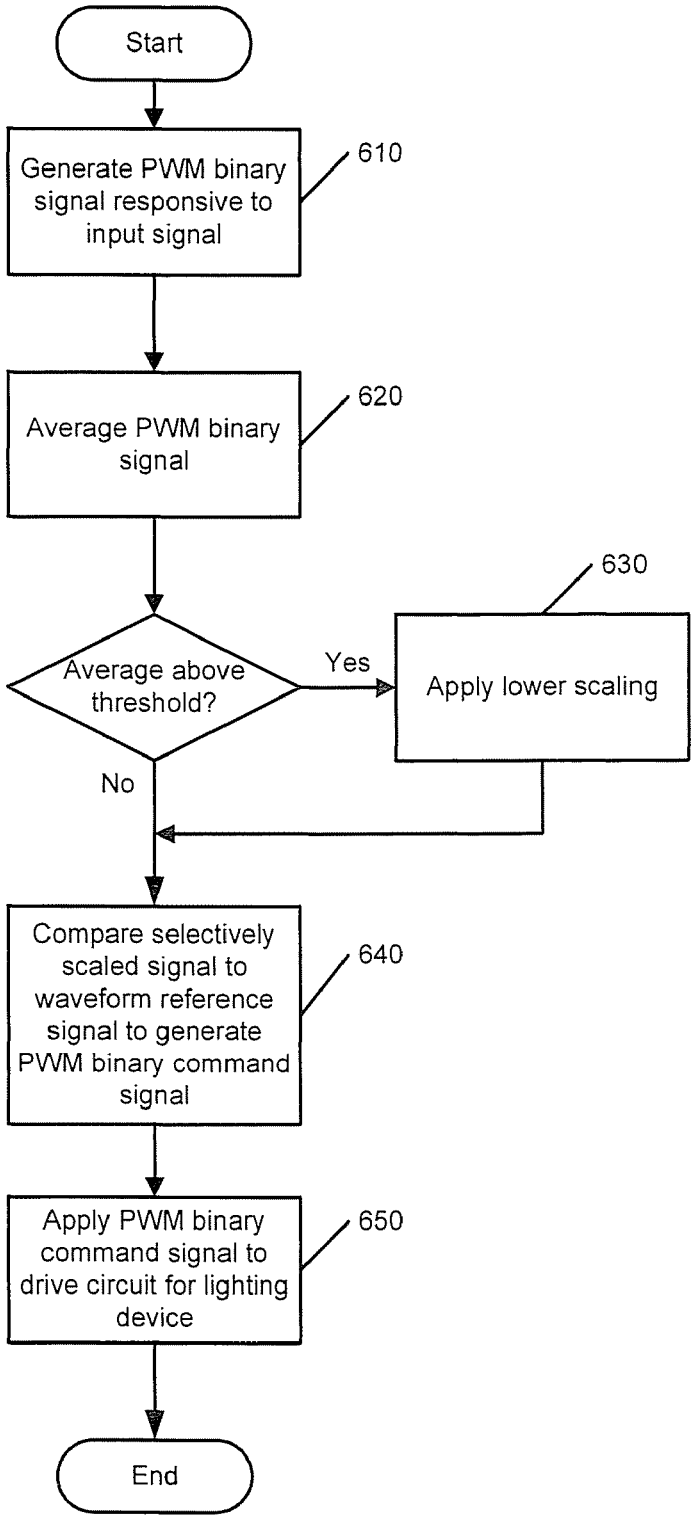

FIGS. 5 and 6 are flowcharts illustrating operations according to some embodiments of the present inventive subject matter. It will be appreciated that the operations illustrated in FIGS. 5 and 6 may be carried out simultaneously or in different sequences without departing from the teachings of the present inventive subject matter. Thus, embodiments of the present inventive subject matter should not be construed as limited to the particular sequence of operations illustrated by the flowcharts. Furthermore, operations illustrated in the flowcharts may be carried out entirely in hardware or in combinations of hardware and software.

Referring to FIG. 5, an average signal representing an average duty cycle of a dimming input signal (e.g., a signal received from an AC phase-cut dimmer or a derivative thereof or a signal derived from an AC power source) is generated (block 510). First and second gains are selectively applied to a dimming control signal (e.g., the average signal and/or a dimming control signal from another source) based on the average signal to generate a dimming command signal (block 520). The dimming command signal is applied to a drive circuit to control driving a lighting device, such as an LED lighting device (block 530).

In operations according to further embodiments of the present inventive subject matter shown in FIG. 6, a PWM binary signal is generated response to a dimming input signal (block 610). An average signal is generated from the PWM binary signal, where a voltage level of an average signal may, for example, represent an average value of the PWM binary signal (block 620). A dimming control signal is scaled based on the level of the average signal. For example, the average signal may be compared to a threshold value and, if the voltage level of the average signal is greater than the threshold, a reduced scaling (gain) is applied to the dimming control signal and the resulting signal compared to a waveform reference signal (e.g., a triangle wave signal) to generate a PWM command signal that is applied to an drive circuit for a lighting device (blocks 630, 640, 650). If the voltage level of the average signal is less than the threshold value, however, the reduced scaling is not applied before comparison with the waveform reference signal and application of the result to the drive circuit (blocks 640, 650).

Figure 7:
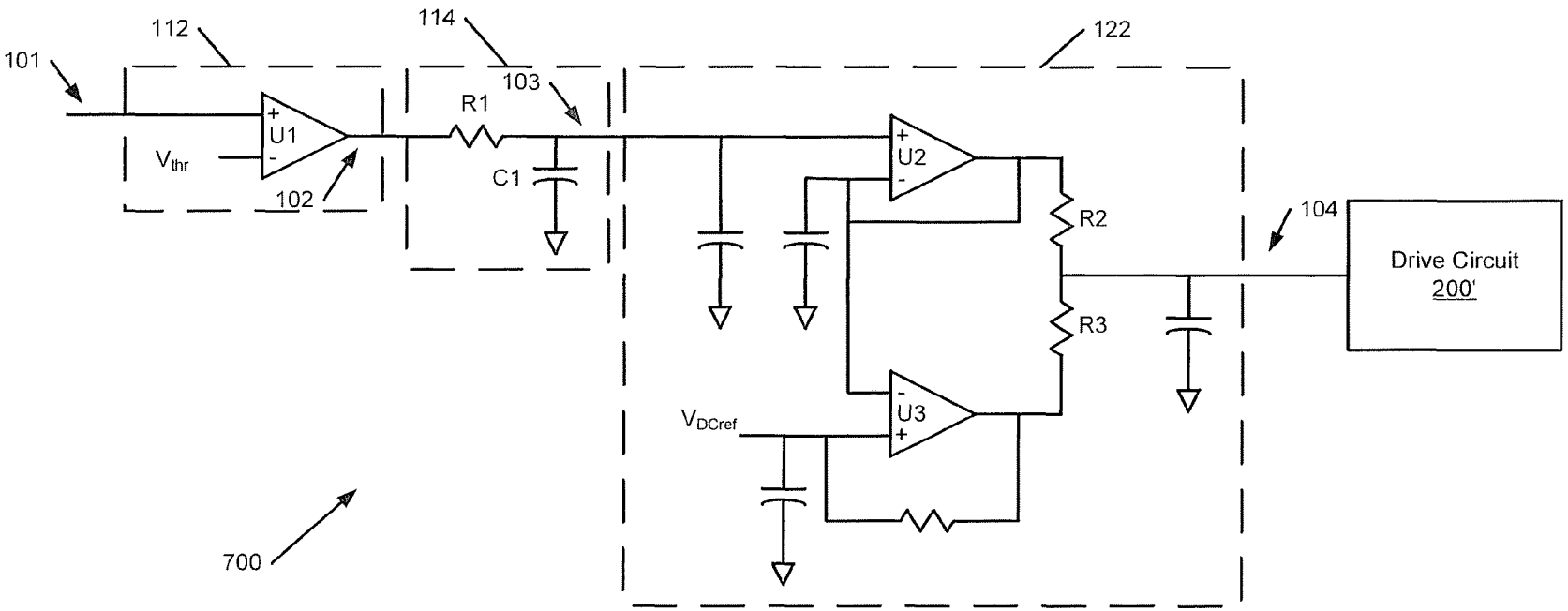
FIGS. 7 and 8 are schematic diagrams illustrating implementations of dimming control according to further embodiments of the present inventive subject matter.

FIG. 7 illustrates further embodiments of the present inventive subject matter, which represents a modification of the circuitry illustrated in FIG. 3 (like components indicated by like reference designators). In particular, in the dimming command signal generation circuit 700 illustrated in FIG. 7, the PWM signal generation circuit 124 of FIG. 3 is omitted to provide an analog signal 104 that may be applied to a drive circuit 200' configured to drive a lighting device responsive to such an output signal. The drive circuit 200' may be, for example, a linear drive circuit.

Figure 8:
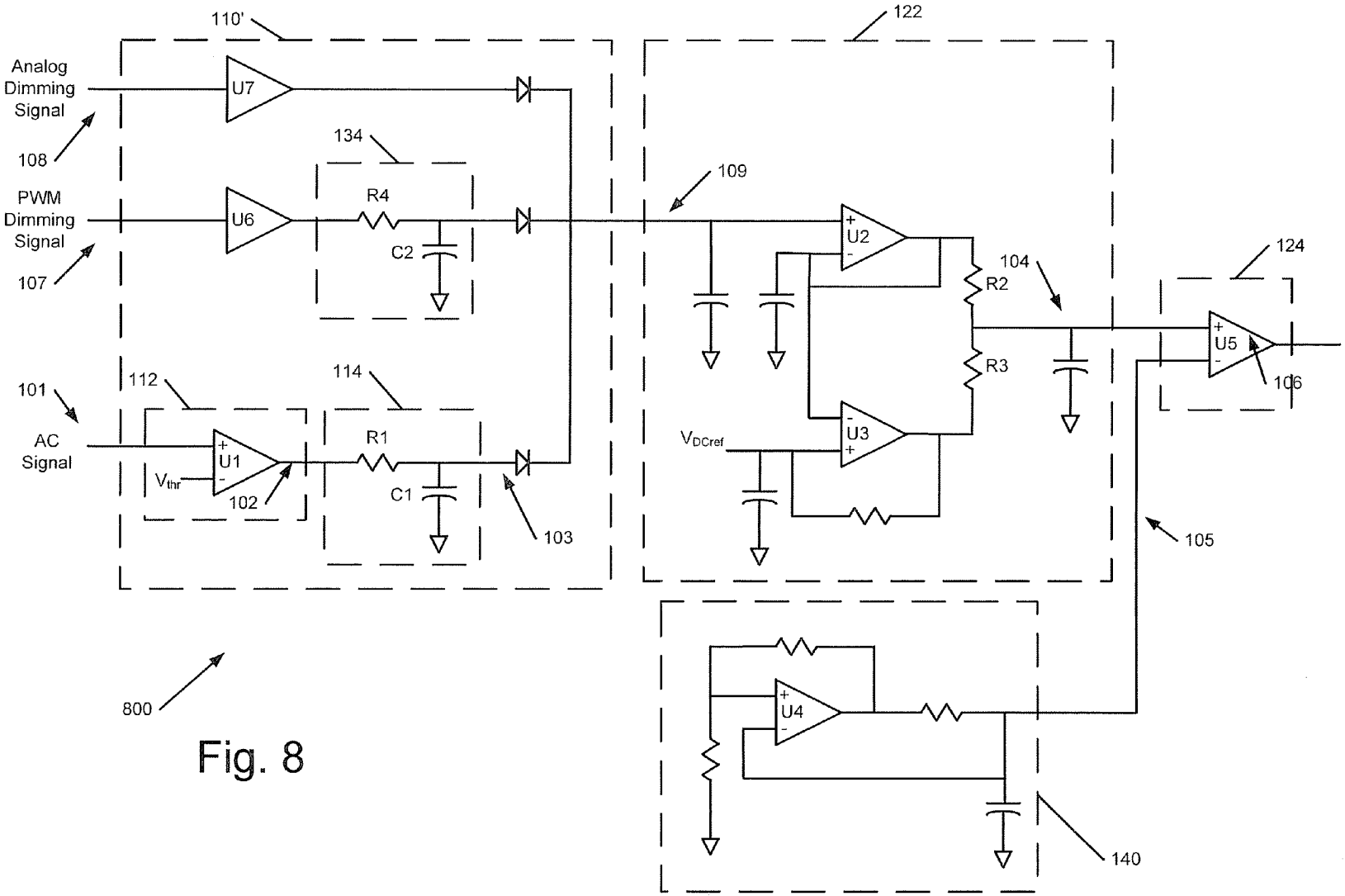

As discussed above, according to some embodiments of the present inventive subject matter, circuitry along the lines described may include circuitry for accepting other types of dimming inputs, such as PWM binary or analog (level-sensitive) dimmer signals. For example, FIG. 8 illustrates a dimming command signal generation circuit 800 that represents another modification of the circuitry of FIG. 3 (like components indicated by like reference designators). A dimming control signal generation circuit 110' may include amplifier circuits U6, U7 that are configured to receive other types of dimmer signals, such as a PWM binary dimmer signal 107 and/or an analog dimmer signal 108 (e.g., a 0-10V signal). The output of the amplifier U6 receiving the PWM binary dimmer signal 107 may be applied to another averaging circuit 116 to produce a signal having a level indicative of the duty cycle of the PWM binary signal 107. As in FIG. 3, a combination of a conversion circuit 112 and an averaging circuit 114 may produce a signal having a level indicative of an average duty cycle of an input signal 101. In the case that dimming is to be controlled by the PWM binary dimmer signal 107 or the analog dimmer signal 108, rather than the input signal 101 being an AC phase-cut dimmer signal as described above, the input signal 101 may be an AC signal derived from an AC power supply that may convert to DC operation under backup power conditions.

The outputs of the averaging circuit 116, the amplifier U7 that receives the analog dimmer signal 108 and the averaging circuit 114 are diode OR'ed, such that a dimming command signal 109 may be selectively generated from these sources. If, for example, the Sense signal input signal 101 is a nominal 50% duty cycle AC signal (corresponding to a normal AC power supply waveform) and the threshold voltage $V_{thr}$ is around zero volts, the average signal 103 produced by the averaging circuit 114 will be around zero volts and the circuit will operate under the control of the PWM binary dimmer signal 107 or the analog dimmer signal 108. Thus, as the operative one of these signals varies to vary dimming over a range between a maximum dimming and a minimum dimming (e.g., little or no dimming, corresponding to a maximum illumination), the dimming control signal 109 will vary accordingly and will be scaled by a first gain. If, however, the AC signal 101 becomes a DC signal, for example, when a backup power condition occurs, control of the dimming control signal 109 is taken over by the average signal 103 (which is now a DC level), and the scaling circuit 122 applies a second, lower gain such that a fixed dimming greater than the minimum dimming is provided. As discussed above, this fixed dimming may be at a level that allows the lighting device being controlled to provide a minimum amount of illumination to meet safety requirements while reducing power consumption.

In the drawings and specification, there have been disclosed embodiments of the invention and, although specific terms are employed, they are used in a generic and descriptive sense only and not for purposes of limitation, the scope of the invention being set forth in the following claims.

That which is claimed is:

1. A lighting control circuit comprising:

an input configured to receive an input signal having a first state in which the input signal is an AC signal and a second state in which the input signal is DC signal;

an output configured to provide a dimming command signal to a drive circuit; and a dimming command signal generation circuit coupled to the input and the output and configured to generate the dimming command signal responsive to the input signal to apply a dimming that varies over a range between a minimum dimming and a maximum dimming responsive to variation of a dimming control signal when the input signal is the AC signal and to apply a fixed dimming greater than the minimum dimming when the input signal is the DC signal.

2. The lighting control circuit of claim 1, wherein the dimming command signal generation circuit comprises:

a dimming control signal generation circuit configured to generate a average signal indicative of an average duty cycle of the input signal; and a variable gain circuit configured to apply a first gain to the dimming control signal to generate the dimming command signal when the average signal meets a predetermined criterion and to apply a second gain to the dimming control signal to generate the dimming command signal when the average signal fails to meet the predetermined criterion.

3. The lighting control circuit of claim 2, wherein the dimming control signal comprises or is derived from the average signal.

4. The lighting control circuit of claim 2, wherein the dimming control signal comprises or is derived from a PWM binary dimmer signal or an analog dimmer signal.

5. The lighting control circuit of claim 2, wherein the dimming control signal generation circuit comprises:

a conversion circuit configured to generate a pulse-width-modulated (PWM) binary signal having a duty cycle corresponding to the duty cycle of the input signal; and an averaging circuit configured to generate an average signal having a level representative of an average of the PWM binary signal.

6. The lighting control circuit of claim 5, wherein the variable gain circuit comprises a selective scaling circuit configured to compare the average signal to a reference signal and to scale the dimming control signal responsive to the comparison.

7. The lighting control circuit of claim 6, wherein the variable gain circuit further comprises a PWM signal generation circuit configured to generate the dimming command signal as a PWM dimming command signal from the scaled dimming control signal.

8. The lighting control circuit of claim 7, wherein the PWM signal generation circuit is configured to compare the scaled dimming control signal to a periodic reference signal to generate the PWM dimming command signal.

9. The lighting control circuit of claim 8, further comprising a periodic reference signal generator configured to generate the periodic reference signal.

10. The lighting control circuit of claim 1, wherein the input signal comprises an AC phase cut dimmer signal with a DC power backup mode or an AC power supply signal with a DC power backup mode.

11. The lighting control circuit of claim 1, further comprising a light-emitting diode (LED) drive circuit configured to drive an LED responsive to the dimming command signal.

12. A lighting system comprising the lighting control circuit of claim 1 in combination with a lighting device and a driver configured to drive the lighting device responsive to the dimming command signal.

13. A lighting control circuit, comprising:

a sense signal input;

a dimming control signal generation circuit configured to generate a dimming control signal; and a variable gain circuit configured to apply a first gain to the dimming control signal responsive to a first state of a signal at the sense signal input to generate a dimming command signal and to apply a second gain to the dimming control signal responsive to a second state of the signal at the sense signal input to generate the dimming command signal.

14. The lighting control circuit of claim 13, wherein the dimming control signal generation circuit is configured to generate the dimming control signal responsive to the signal at the sense signal input.

15. The lighting control circuit of claim 14, wherein the dimming control signal generation circuit is configured to generate the dimming control signal responsive to an AC phase-cut dimmer signal and wherein the variable gain circuit is configured to selectively apply the first and second gains responsive to the AC phase-cut dimmer signal.

16. The lighting control circuit of claim 13, wherein the dimming control signal generation circuit is configured to generate the dimming control signal responsive to a PWM binary dimmer signal or an analog dimmer signal.

17. The lighting control circuit of claim 13, wherein the dimming control signal generation circuit is configured to determine an average duty cycle of the signal at the sense signal input and wherein the variable gain circuit is configured to selectively apply the first and second gains responsive to the determined duty cycle.

18. The lighting control circuit of claim 17, wherein the dimming control signal generation circuit comprises:

a conversion circuit configured to generate a pulse-width-modulated (PWM) binary signal having a duty cycle corresponding to the duty cycle of the signal at the sense signal input; and an averaging circuit configured to generate an average signal having a level representative of an average of the PWM binary signal.

19. The lighting control circuit of claim 18, wherein the variable gain circuit comprises:

a selective scaling circuit configured to compare the average signal to a reference signal and to scale the dimming control signal responsive to the comparison; and a PWM signal generation circuit configured to generate the dimming command signal as a PWM dimming command signal from the scaled dimming control signal.

20. The lighting control circuit of claim 19, wherein the PWM signal generation circuit is configured to compare the scaled dimming control signal to a periodic reference signal to generate the PWM dimming command signal.

21. The lighting control circuit of claim 20, further comprising a periodic reference signal generator circuit configured to generate the periodic reference signal.

22. The lighting control circuit of claim 13, further comprising a light-emitting diode (LED) drive circuit configured to drive an LED responsive to the dimming command signal.

23. A lighting system comprising the lighting control circuit of claim 13 in combination with a lighting device and a drive circuit configured to drive the lighting device responsive to the dimming command signal.

24. A method of controlling lighting, comprising:

receiving an input signal having a first state in which the input signal is an AC signal and a second state in which the input signal is DC signal; and generating a dimming command signal responsive to the received input signal; and applying the dimming command signal to a drive circuit, wherein generating the dimming command signal comprises applying a dimming that varies over a range between a minimum dimming and a maximum dimming responsive to a dimming control signal when the input signal is the AC signal and applying a fixed dimming greater than the minimum dimming when the input signal is the DC signal.

25. The method of claim 24, further comprising:

generating an average signal indicative of an average duty cycle of the input signal;

applying a first gain the dimming control signal when the average signal meets a predetermined criterion to generate the dimming command signal; and applying a second gain to the dimming control signal when the average signal fails to meet the predetermined criterion to generate the dimming command signal.

26. The method of claim 25, wherein the dimming control signal comprises or is derived from the input signal.

27. The method of claim 26, wherein the input signal comprises an AC phase-cut dimmer signal.

28. The method of claim 25, wherein the dimming control signal comprises or is derived from a PWM binary dimmer signal or an analog dimmer signal.

29. The method of claim 25, wherein generating an average signal indicative of an average duty cycle of the input signal comprises:

generating a pulse-width-modulated (PWM) binary signal having a duty cycle corresponding to the duty cycle of the input signal; and generating an average signal having a level representative of an average of the PWM binary signal.

30. A lighting control circuit comprising:

an input configured to receive an input signal having a first state in which the input signal is an AC signal and a second state in which the input signal is DC signal from a battery source;

an output configured to provide a dimming command signal to a drive circuit; and a dimming command signal generation circuit configured to determine whether the input signal is the AC signal or the DC signal from a battery source, and to responsively generate the dimming command signal based on the determination of whether the input signal is the AC signal or the DC signal from a battery source.

31. A lighting control circuit comprising:

a dimming command signal generation circuit configured to receive an input signal, to determine whether the input signal is an AC signal or a DC signal, and to responsively generate a dimming command signal based on the determination of whether the input signal is an AC signal or a DC signal, wherein the dimming command signal generation circuit comprises:

a dimming control signal generation circuit configured to generate an average signal indicative of an average duty cycle of the input signal; and a variable gain circuit configured to apply a first gain to a dimming control signal to generate the dimming command signal when the average signal meets a predetermined criterion and to apply a second gain to the dimming control signal to generate the dimming command signal when the average signal fails to meet the predetermined criterion.

32. A method of controlling lighting, comprising:

receiving an input signal having a first state in which the input signal is an AC signal and a second state in which the input signal is DC signal from a battery source;

determining whether the input signal is the AC signal or the DC signal from a battery source; and generating a dimming command signal based on the determination of whether the input signal is an AC signal or a DC signal.

33. A method of controlling lighting, comprising:

receiving an input signal;

determining whether the input signal is an AC signal or a DC signal, wherein determining whether the input signal is an AC signal or a DC signal comprises:

generating an average signal indicative of an average duty cycle of the input signal; and determining whether the average signal meets a predetermined criterion; and generating a dimming command signal based on the determination of whether the input signal is an AC signal or a DC signal, wherein generating a dimming command signal based on the determination of whether the input signal is an AC signal or a DC signal comprises applying a first gain to a dimming control signal to generate the dimming command signal when the average signal meets the predetermined criterion and applying a second gain to the dimming control signal to generate the dimming command signal when the average signal fails to meet the predetermined criterion.

* * * * *

UNITED STATES PATENT AND TRADEMARK OFFICE

CERTIFICATE OF CORRECTION

PATENT NO. : 8,217,591 B2
APPLICATION NO. : 12/473821
DATED : July 10, 2012
INVENTOR(S) : Chobot et al.

It is certified that error appears in the above-identified patent and that said Letters Patent is hereby corrected as shown below:

In the Claims:

Column 11, Claim 2, Line 24: correct "generate a average signal"
to read -- generate an average signal --

Column 13, Claim 25, Line 20: correct "applying a first gain the dimming"
to read -- applying a first gain to the dimming --

Signed and Sealed this
Eleventh Day of June, 2013

Teresa Stanek Rea
*Acting Director of the United States Patent and Trademark Office*